US006773761B2

(12) United States Patent
Cote et al.

(10) Patent No.: US 6,773,761 B2
(45) Date of Patent: Aug. 10, 2004

(54) METHOD OF APPLYING A VARNISH TO A COMPONENT, IN-PARTICULAR TO A VEHICLE HEADLIGHT REFLECTOR

(75) Inventors: Frédéric Cote, Bobigny (FR); Michel Montaudouin, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 10/424,481

(22) Filed: Apr. 28, 2003

(65) Prior Publication Data

US 2003/0203107 A1 Oct. 30, 2003

(30) Foreign Application Priority Data

Apr. 30, 2002 (FR) ..... 02 05531

(51) Int. Cl.[7] ..... B05D 1/04

(52) U.S. Cl. ..... 427/458; 427/162; 427/299; 427/331; 427/385.5; 427/421; 427/422; 427/425; 427/457; 427/508; 427/521; 427/532; 427/561

(58) Field of Search ..... 427/457, 508, 427/521, 532, 561, 162, 299, 331, 385.5, 421, 422, 425, 458

(56) References Cited

U.S. PATENT DOCUMENTS 4,396,651 A 8/1983 Behmel et al. ..... 427/421

5,558,943 A 9/1996 Zwecker et al. ..... 428/458

FOREIGN PATENT DOCUMENTS

| | | |
|---|---|---|
| EP | 0681000 | 8/1995 |
| FR | 1 436 606 | 3/1966 |
| FR | 2483267 | 4/1981 |
| FR | 2447794 | 8/1995 |
| GB | 1386324 | 3/1975 |
| GB | 2 042 930 A | 10/1980 |

OTHER PUBLICATIONS

French Patent Report, FR 0205531, FA 618160, Jan. 31, 2003.

European Patent Report, EP 95 10 1269, D. Krische, Aug. 9, 1995.

*Primary Examiner*—Bernard Pianalto

(74) *Attorney, Agent, or Firm*—Morgan & Finnegan, LLP

(57) ABSTRACT

A method of applying a varnish, whether or not it includes a solvent, on a component, in particular a vehicle headlight reflector, comprises the following steps: (i) selecting a varnish having a viscosity at ambient temperature of about 500 to 2000 mPa.s, and a viscosity at the application temperature which is lower than about 200 mPa.s, with a viscosity which is substantially independent of variation in the temperature within the range of application; (ii) heating the surface of the component before the step of moistening the varnish at a selected temperature $\theta p_1$; (iii) heating the varnish at the moment of application to a selected temperature $\theta v$; and (iv) during the spreading step, maintaining the component at a selected temperature $\theta p_2$ for a selected time $tp_2$.

13 Claims, No Drawings

METHOD OF APPLYING A VARNISH TO A COMPONENT, IN-PARTICULAR TO A VEHICLE HEADLIGHT REFLECTOR

FIELD OF THE INVENTION

The present invention relates to a method of applying a varnish, including a solvent or free of any solvent, on a component which may in particular be a vehicle headlight reflector.

BACKGROUND OF THE INVENTION

The majority of basic compositions of varnishes which are applied on components of the type that include vehicle headlight reflectors made from solid moulding mixtures such as BMC, CIC and so on, contain large quantities of solvents. The presence of these solvents is judged necessary in order to reduce the viscosity of the products applied and to improve the application performance, for example by spraying. During the spraying step and then during the period of removal of the solvents, the solvents evaporate wholly or partly. The time during which trapped air bubbles are able to escape and the varnish film is able to spread, depends on the viscosity of the products used and the nature and residual concentration of the solvents. The longer is the solvent removal time, the greater are the risks of increased flowing out of the varnish on the surface of the components, so giving rise to numerous rejects.

DISCUSSION OF THE INVENTION

The Applicant has accordingly set the particular objective of obtaining excellent performance of the application of a varnish on components of the vehicle headlight reflector type, while limiting its tendencies to "flow out" on the surface after application and without reducing the qualities of appearance in the base coating film.

This object is achieved by the present invention, which provides a method of applying a varnish, whether or not it includes a solvent, on a component, in particular a vehicle headlight reflector, characterised in that it comprises the following steps, namely: (i) selecting a varnish having a viscosity at ambient temperature in the range from about 500 mPa.s to 2000 mpa.s, and a viscosity at the application temperature which is lower than about 200 mPa.s, with a viscosity which is substantially independent of variation in the temperature within the range of application; (ii) heating the surface of the component before the step of moistening the varnish at a selected temperature $\theta p_1$; (iii) heating the varnish at the moment of application to a selected temperature $\theta v$; and (iv) during the spreading step, maintaining the component at a selected temperature $\theta p_2$ for a selected time $tp_2$.

The varnishes, whether or not they contain a solvent, generally consist of resins the viscosity of which is directly linked to temperature.

The method according to the invention, which may be performed equally well, whether or not the varnish contains a solvent, through the choice of appropriate varnishing temperatures, enables excellent application performance to be guaranteed, in particular by spray application. The selection of temperatures for the component to be varnished, before the application step and during spreading, also enables, in particular, the wettability of the varnish and its mobility to be controlled and optimised. In practice, the viscosity of the varnish achieves its optimum value at these selected temperatures. When applied on a hot surface, excellent wettability is obtained on the one hand, and removal of bubbles from the varnish is accelerated on the other hand. On cooling, viscosity increases rapidly so that the risks of flowing out are reduced.

Preferably, in the method according to the invention, step (ii) consists in heating by radiation, convection or conduction, for example using a forming tool, and step (iv) consists in heating by radiation or convection. This type of heating enables correct spreading to be obtained for the smoothest possible optical surface.

In a first embodiment in which the varnish includes a solvent, $\theta v$ is about 20 to 40° C., $\theta p_1$ is about 20 to 50° C., and $\theta p_2$ and $tp_2$ about 20 to 50° C. and about 0.5 to 3 min, respectively.

By comparison with methods with traditional solvents, in which the solvent conventionally represents about 20% to 70% by weight of the overall varnish composition, in the method of the invention the solvent does not represent more than 10% by weight of the overall composition of the varnish used. Solvent removal times in the method according to the invention are therefore diminished overall, which greatly reduces the cost.

In a second embodiment of the method of the invention, the varnish being solvent free, the temperature $\theta v$ is about 40 to 60° C., the temperature $\theta p_1$ is about 70 to 110° C., the temperature $\theta p_2$ is about 50 to 90° C., and the time $tp_2$ is about 0.5 to 1.5 min.

One of the major advantages of this embodiment is first that the varnish formulations are simplified and it is performed without solvents. Apart from their volatile nature, solvents have a toxicity level which may be more or less acceptable, and are a significant fire risk. These constraints usually make it necessary to have in place installations for treatment of the volatiles, together with fire fighting equipment in all the zones concerned. This embodiment therefore enables economies of investment and exploitation to be achieved by simplification of the plant, since the application zone is equipped with fire prevention means because of the need for cleaning the material. It also has the advantage of putting the plant into conformity with even stricter regulations in regard to the environment.

The complementary or alternative features of the method according to the invention are as follows:

- The varnish is applied by spraying under pressure ("airless"), with a compressed air or electrostatic spraygun; preferably, the spraygun is equipped with a thermo-regulated flow loop, which enables the viscosity of the varnish to be reduced and enables the temperature $\theta v$ and the varnish flow to be constant at the moment of spraying by the spraygun. Without the said loop, temperature control problems would arise because the spraygun works intermittently; the thickness of the varnish is obtained in a single pass of the spraygun: the varnish is deposited perfectly on the workpiece and no retouching is necessary; when the varnish applied by the spraygun is a solvent-free varnish, this enables major variations to be obtained in the thickness which are compatible with the complex geometry of the surface being covered, and this increases the robustness of the method; with identical thickness, two passes of the spraygun are in general necessary in the case where the varnish does have a solvent.
- The varnish is a UV varnish: compared to so-called thermal varnishes, UV varnishes save a certain amount of time, because once the required appearance has been obtained the latter is "set" practically instantaneously, compared with times of the order of 5 to 10 minutes which are necessary with thermal varnishes. During these setting times, the atmosphere of the plant must remain very clean and "dust free".

When applied on a component such as a BMC component, the method includes a step of pre-treatment with UV radiation at about 1 to 4 J/cm$^2$ with a maximum power of about 130 to 250 mW, measured in the UVA band and in a plane substantially at right angles to the mean radiation of the UV illumination zone. Effectiveness of treatment of the surface of the workpiece, and adherence of the varnish on the BMC are thus guaranteed.

The method includes a step of polymerisation step with UV radiation at between about 4 and 8 J/cm$^2$, and preferably about 2 to 4 J/cm$^2$ with a maximum power of about 80 to 200 mW measured in the UVA band and in a plane substantially at right angles to the mean radiation of the UV illumination zone. In this way a brilliant spread-out surface, capable of being metallised, is obtained.

The orientation of the light radiation from each emitter, or the putting of the workpiece in motion, are optimised, which enables homogeneous illumination to be guaranteed regardless of the complexity of the exposed surface; in practice, the emitters are inclined so as to take the orientation of the faces of the component into account;

In the UV polymerisation step, in which varnish temperature $\theta p_2$ is high, the varnish is more reactive. This increase in reactivity enables the number of UV emitters to be substantially reduced, while zones which are generally difficult to expose are polymerised;

The method includes a step of rotating the component about a horizontal axis in the course of the spreading and/or polymerising step, which enables flowing-out effects to be avoided and also enables the maximum thickness of the deposited layer to be increased on application, all this regardless of the form of the component being treated. In this way the soundness of the application method is increased.

The present invention will now be described in more detail, as to its general features, and then with the aid of an example of an embodiment given by way of non-limiting illustration.

DESCRIPTION OF A PREFERRED EMBODIMENT OF THE INVENTION

In general terms, after injection of a component of thermosetting material, a method of applying a UV varnish comprises the conventional steps of washing the workpiece in water, drying, UV pre-treatment, application of the heated varnish, or a so-called "moistening" step, "spreading", UV polymerisation, and metallisation.

The method of the invention may be applied to any workpiece capable of supporting transient temperatures up to about 110° C.

In the case of reflectors for vehicle headlights, there may be mentioned, by way of components in thermosetting material that can be used in the method of the invention, mixtures for moulding which are solid, or BMC, meaning "bulk moulding compounds" (or their variants such as CIC, which means "continuous impregnated compounds", TMC which means "thick moulding compounds", or again, SMC which means "sheet moulding compounds"), which are unsaturated polyester resin based compositions reinforced with glass fibre. Components of phenolic, vinyl or epoxy resins, or again urea-formol melamines, can also be suitable.

As a UV varnish that can be used in the method of the invention, mention may be made of the compositions which conventionally include an acrylic resin or a mixture of acrylic resins, with the optional addition of one or more solvents.

The acrylic resins used in the method of the invention may comprise one or more of the following compositions:

Polymers or co-polymers of esters of acrylic acid such as multi-functional acrylate oligomers, for example of the epoxy acrylate, aliphatic or aromatic urethane acrylate, polyester acrylate, or acrylic acrylate types; these compounds are typically viscous liquids having at 25° C. a viscosity in the range from around a few thousands to around more than a million centipoise (cP), having in general 2 to 6 acrylate groups per molecule and possessing a molecular weight in the range from about 500 to about 20,000.

Multi-functional acrylate monomers having in general from 1 to 4 acrylate groups per molecule and a molecular weight in the range from about 150 to about 500, their viscosity at 25° C. being in the range from about 5 to about 200 cP.

Hexanedioidiacrylate (HDDA), tripropyleneglycoldiacrylate (TPDGA), triethyleneglycoldiacrylate (TEGDA), and dipropyleneglycoldiacrylate (DPGDA), and monomers of the acrylic acid type.

One or more photo-initiators of the arylketone type, for example benzophenone, hydroxycyclohexylphenylketone (HCPK), and 2,2-dimethoxy-1,2-diphenylmethane-1-one.

One or more tensioactive agents of the alkylpolysiloxane type, such as dimethylpolysiloxane or methacrylatesiloxane, a polyethersiloxane or polyestersiloxane.

Other additives may be added to the foregoing compounds, such as for example one or more anti-foaming agents, adhesion promoters, thixotropic agents, stabilisers, colouring agents, etc.

When they are present in the performance of the method of the invention, the appropriate solvents are for example solvents of an ester type, such as for example ethyl acetate, vinyl or butyl acetate, or again, of the glycol ester type such as methoxypropyleneacetate (MPA), or of the ketone type, such as for example methylisobutylketone (MIBK) or methylethylketone (MEK), or, again, of the alcohol type such as butylic alcohol or, finally, of an aromatic type such as toluene or xylene for example.

EXAMPLE 1

A Method of Applying a Varnish with a Solvent on BMC Workpieces

The characteristic steps essential to the method according to the invention are as follows:

Nature of the varnish: acrylic resin includes vinyl acetate in the amount of 5% by weight of the overall composition of the varnish; the varnish has a viscosity at ambient temperature in the range from about 500 mPa.s to 2000 mPa.s, and a viscosity at the application temperature which is less than about 200 mPa.s, with viscosity being substantially independent of variation in the temperature within the application range.

UV pre-treatment (dose: 4 J/cm$^2$; power: 160 mW/cm$^2$, measured in UVA).

Heating the workpieces to 40° C. before moistening (wetting).

Heating the varnish (spraying temperature, using the compressed air spraygun with thermo-regulating loop: 35° C.).

Holding the temperature during the spreading step (flash off temperature: 35° C., for 1 minute; workpiece is rotated at 2 rev/min).

UV polymerisation (dose: 6 J/cm$^2$; power: 160 mW/cm$^2$, measured in UVA).

Aluminising.

The thickness of the varnish layer obtained is of the order of 10 to 25 $\mu$m. The above application range enables a component to be produced which has the optical qualities needed for a motor vehicle headlight reflector (brilliance, spread and appearance of the optical surface).

EXAMPLE 2

A Method of Applying a Solvent-Free Varnish on BMC Workpieces

The essential characteristics of the method according to the invention are as follows:

Nature of the varnish: acrylic resin (% of volatiles less than 1%); the varnish has a viscosity at ambient temperature in the range from about 500 mPa.s to 2000 mPa.s, and a viscosity at the application temperature of less than about 200 mPa.s, with viscosity being substantially independent of the variation in temperature within the application range.

Heating or holding the workpieces at 90° C.

UV pre-treatment (dose: 2 J/cm$^2$; power: 160 mW/cm$^2$, measured in UVA).

Heating or holding the workpieces at 90° C. before moistening (wetting).

Heating the varnish (temperature for spraying with the compressed air spraygun having a thermo-regulating loop: 45° C.).

Holding the temperature during the spreading step (flash off temperature: 70° C. for 1.5 minutes; workpiece is rotated at 2 rev/min).

UV polymerisation (dose: 2 J/cm$^2$; power: 160 mW/cm$^2$, measured in UVA).

Aluminising.

It is found that controlling of the surface temperature in accordance with the method of the invention enables moistenability (wettability) and spread to be controlled.

The choice of flash-off temperature enables the surface appearance (spreading, bubble removal, flow-off) to be controlled.

The properties of heat resistance (30 min at 200° C.) and resistance to humid heat (7 days at 70° C. and 95% residual humidity) are such that after the tests, the appearance of the metallisation remains unchanged.

The thickness of the base coating layer obtained is about 10 $\mu$m at a minimum, and may reach from about 15 $\mu$m to about 50 $\mu$m in a single pass of the spraygun.

Apart from the excellent performance mentioned above which the method according to the invention makes it possible to obtain, the invention leads with great advantage to a substantial simplification of plant. A drastic reduction in pollution and fume treatment, in terms of investment and maintenance, is also ensured.

What is claimed is:

1. A method of applying a varnish, with or without a solvent, to a component, in-particular to a vehicle headlight reflector, the method comprising:

(i) selecting a varnish having a viscosity at ambient temperature in the range from about 500 mPa.s to 2000 mPa.s, a viscosity at an application temperature which is lower than about 200 mPa.s the viscosity being substantially independent of variation in temperature within a temperature range of application;

(ii) heating a surface of the component to a selected temperature $\theta p_1$ prior to application of the varnish to the component;

(iii) heating the varnish to a selected temperature $\theta v$, at the moment of application of the varnish to the component; and (iv) maintaining the component at a selected temperature $\theta p_2$ for a selected time $tp_2$, during spreading of the varnish on the component.

2. A method according to claim 1, wherein step (ii) consists of heating by radiation, convection or conduction, and step (iv) consists of heating by radiation or convection.

3. A method according to claim 1, wherein the varnish includes a solvent, and $\theta v$ is in the range from about 20° C. to about 40° C., $\theta p_1$ is in the range from about 20° C. to about 50° C., and $\theta p_2$ and $tp_2$ are in the range from about 20° C. to about 50° C. and about 0.5 mm to 3 mm, respectively.

4. A method according to claim 1, wherein the varnish is solvent free, and the temperature $\theta v$ is in the range from about 40° C. to about 60° C., the temperature $\theta p_1$ is in the range from about 70° C. to about 110° C., the temperature $\theta p_2$ is in the range from about 50° C. to about 90° C., and the time $tp_2$ is in the range from about 0.5 mm to about 1.5 mm.

5. A method according to claim 1, wherein the application step is performed by airless spraying under pressure, with a compressed air or electrostatic spraygun.

6. A method according to claim 5, wherein a compressed air spraygun is used, and is equipped with a thermo-regulated flow loop.

7. A method according to claim 5, wherein a full thickness of the varnish layer is obtained in a single passage of the spraygun.

8. A method according to claim 1, wherein the varnish is a UV varnish.

9. A method according to claim 8, further comprising polymerisation of the varnish with UV radiation in the range from about 2 J/cm$^2$ to about 4 J/cm$^2$ with a maximum power in the range from about 80 mW to about 200 mW measured in the UVA band and in a plane substantially at right angles to the mean radiation of a UV illumination zone.

10. A method according to claim 9, further comprising rotating the component about a horizontal axis in the course of polymerisation of the varnish.

11. A method according to claim 8, further comprising pre-treating the component with UV radiation in the range from about 1 J/cm$^2$ to about 4 J/cm$^2$ with a maximum power in the range from about 130 mW to about 250 mW measured in the UVA band and in a plane substantially at right angles to the mean radiation of the UV illumination zone.

12. The method of claim 11, wherein the component is manufactured from a bulk moulding compound, continuous impregnated compound, thick moulding compound, or sheet moulding compound.

13. A method according to claim 1, further comprising rotating the component about a horizontal axis in the course of spreading the varnish on the component.

* * * * *

UNITED STATES PATENT AND TRADEMARK OFFICE

CERTIFICATE OF CORRECTION

PATENT NO. : 6,773,761 B2 
DATED : August 10, 2004
INVENTOR(S) : Frédéric Cote and Michel Montaudouin It is certified that error appears in the above-identified patent and that said Letters Patent is hereby corrected as shown below:

Column 6,
Line 5, "about 0.5 mm to 3 mm" should read -- about 0.5 min to 3 min --
Lines 6-7, "about 0.5 mm to about 1.5 mm" should read -- about 0.5 min to about 1.5 min --

Signed and Sealed this

Fourteenth Day of December, 2004

JON W. DUDAS
*Director of the United States Patent and Trademark Office*